US009392374B2

(12) United States Patent
Hirayama et al.

(10) Patent No.: US 9,392,374 B2
(45) **Date of Patent: *Jul. 12, 2016**

(54) ACOUSTIC GENERATOR, ACOUSTIC GENERATION DEVICE, AND ELECTRONIC DEVICE

(71) Applicant: KYOCERA Corporation, Kyoto-shi, Kyoto (JP)

(72) Inventors: Takeshi Hirayama, Kirishima (JP); Shuichi Fukuoka, Kirishima (JP); Noriyuki Kushima, Kirishima (JP); Saneaki Akieda, Nagoya (JP); Hiroshi Ninomiya, Kirishima (JP)

(73) Assignee: Kyocera Corporation, Kyoto-shi, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/410,816

(22) PCT Filed: Jul. 31, 2013

(86) PCT No.: PCT/JP2013/070806
§ 371 (c)(1),
(2) Date: Dec. 23, 2014

(87) PCT Pub. No.: WO2014/024756
PCT Pub. Date: Feb. 13, 2014

(65) Prior Publication Data

US 2015/0201281 A1 Jul. 16, 2015

(30) Foreign Application Priority Data

Aug. 10, 2012 (JP) ..... 2012-179066

(51) Int. Cl.
*H04R 17/00* (2006.01)
*H04R 7/10* (2006.01)

(52) U.S. Cl.
CPC . *H04R 17/00* (2013.01); *H04R 7/10* (2013.01)

(58) Field of Classification Search
CPC ..... H04R 2440/00–2440/07; H04R 17/02; H04R 2217/00–2217/03; H04R 7/04
USPC ..... 381/152, 173, 190, 431
See application file for complete search history.

(56) References Cited

U.S. PATENT DOCUMENTS 6,278,790 B1 * 8/2001 Davis et al. ..... 381/190
2003/0048914 A1 * 3/2003 Yi et al. ..... 381/190

(Continued)

FOREIGN PATENT DOCUMENTS

JP 2012-015760 A 1/2012
JP 2012-060513 A 3/2012
JP 2012-110018 A 6/2012

OTHER PUBLICATIONS

International Search Report, PCT/JP2013/070806, Sep. 30, 2013, 1 pg.

*Primary Examiner* — Suhan Ni
(74) *Attorney, Agent, or Firm* — Volpe and Koenig, P.C.

(57) ABSTRACT

An acoustic generator according to an aspect of an embodiment includes a frame, a vibration body, and a piezoelectric vibration element. The vibration body is provided at an inner side of the frame. The piezoelectric vibration element is provided on the vibration body. The vibration body has a configuration in which a thin plate-like first portion and a thin plate-like second portion having different elastic moduli are laminated.

20 Claims, 6 Drawing Sheets

(56) References Cited

U.S. PATENT DOCUMENTS

2012/0148073 A1* 6/2012 Kim et al. ..... 381/190
2013/0094681 A1 4/2013 Fukuoka et al.
2013/0322663 A1* 12/2013 Melcher et al. ..... 381/190
2014/0314255 A1 10/2014 Fukuoka et al.

* cited by examiner

ACOUSTIC GENERATOR, ACOUSTIC GENERATION DEVICE, AND ELECTRONIC DEVICE

CROSS-REFERENCE TO RELATED APPLICATIONS

This application is national stage application of International Application No. PCT/JP2013/070806, filed on Jul. 31, 2013, which designates the United States, incorporated herein by reference, and which claims the benefit of priority from Japanese Patent Application No, 2012-179066, filed on Aug. 10, 2012, the entire contents of which are incorporated herein by reference.

FIELD

The disclosed embodiments relate to an acoustic generator, an acoustic generation device, and an electronic device.

BACKGROUND

Conventionally, piezoelectric speakers have been known as small-sized thin acoustic generators. As the conventional piezoelectric speakers, there is exemplified a piezoelectric speaker including a rectangular frame, a film provided on the frame in a tension manner, and a piezoelectric vibration element provided on the film (for example, see Patent Literature 1).

CITATION LIST

Patent Literature

Patent Literature 1: Japanese Patent Application open No. 2012-60513

SUMMARY

Technical Problem

The piezoelectric speaker disclosed in Patent Literature 1, however, has the following problem. That is, peaks (portions having sound pressure higher than the periphery) and dips (portions having sound pressure lower than the periphery) are generated in frequency characteristics of the sound pressure due to a resonance phenomenon, and drastic frequency-related variation of the sound pressure occurs. In addition, there is a problem that frequency-related variation also occurs in average sound pressure obtained by averaging the peaks and the dips because distribution of the peaks due to the resonance phenomenon is uneven and so on.

Solution to Problem

An acoustic generator according to an aspect of an embodiment includes a frame, a vibration body, and a piezoelectric vibration element. The vibration body is provided at an inner side of the frame. The piezoelectric vibration element is provided on the vibration body. The vibration body has a configuration in which a thin plate-like first portion and a thin plate-like second portion having different elastic moduli are laminated.

DESCRIPTION OF EMBODIMENTS

Hereinafter, embodiments of an acoustic generator, an acoustic generation device, and an electronic device that are disclosed by the present application will be described with reference to the accompanying drawings. It should be noted that the respective embodiments as will be described below do not limit the invention.

First Embodiment

Figure 1A:
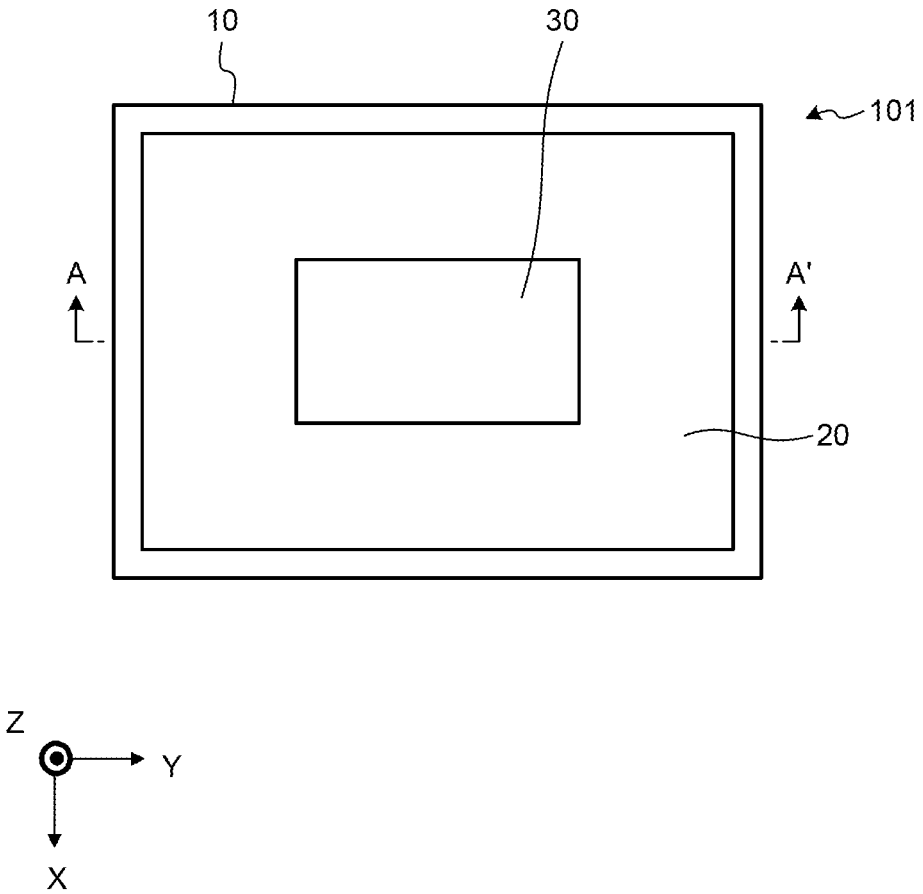
FIG. 1A is a plan view schematically illustrating an acoustic generator according to a first embodiment.
Figure 1B:
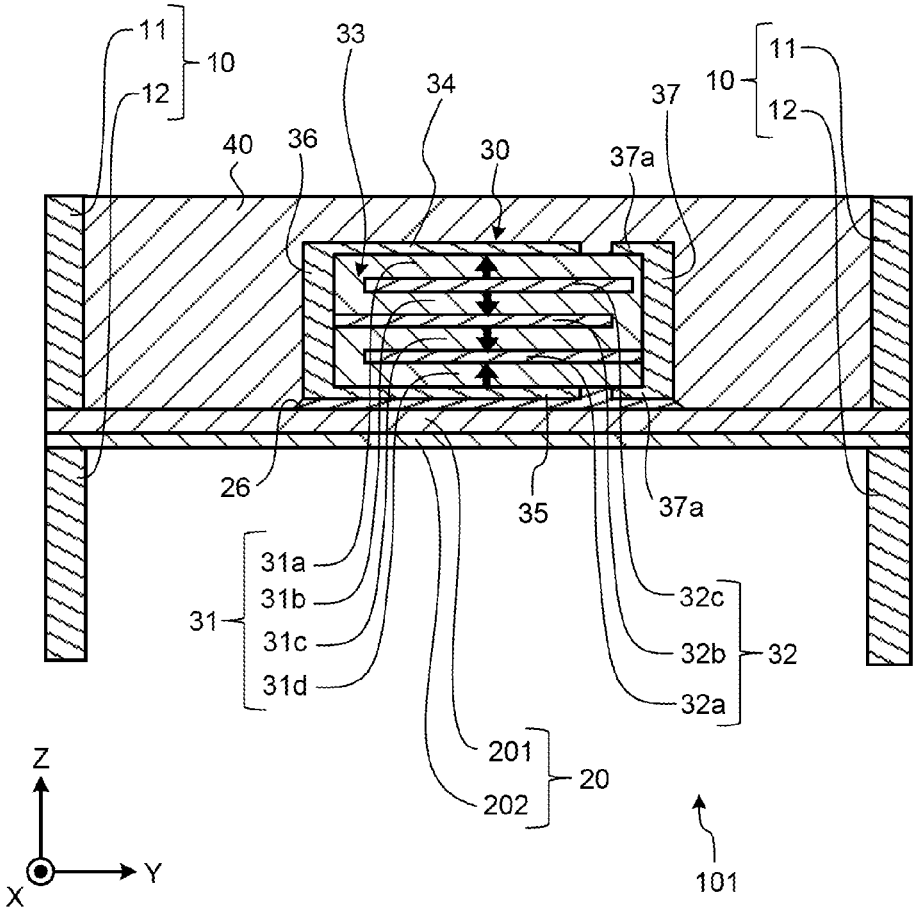
FIG. 1B is a cross-sectional view cut along line I-I' in FIG. 1A.

The configuration of an acoustic generator 101 according to a first embodiment will be described with reference to FIG. 1A and FIG. 1B. FIG. 1A is a plan view illustrating the acoustic generator 101 in the first embodiment when seen from the thickness direction (direction perpendicular to the main surface and +Z direction in FIG. 1A) of a vibration body 20. FIG. 1B is a cross-sectional view cut along line I-I' in FIG. 1A. In order to facilitate understanding, FIG. 1A illustrates a state where a resin layer 40 is seen through and FIG. 1B illustrates the acoustic generator 101 while enlarging it in the Z-axis direction.

As illustrated in FIG. 1A and FIG. 1B, the acoustic generator 101 in the first embodiment includes a frame 10, the vibration body 20 provided at the inner side of the frame 10, a piezoelectric vibration element 30 provided on the vibration body 20, and the resin layer 40. The vibration body 20 has a configuration in which a thin plate-like first portion 201 and a thin plate-like second portion 202 having different elastic moduli are laminated.

The first portion 201 is made of a material having an elastic modulus different from that of a material of the second portion 202, so that the elastic modulus of the first portion 201 is different from that of the second portion 202. To be specific, the elastic modulus of the first portion 201 is set to be lower than that of the second portion 202. Furthermore, the first portion 201 is made of a material having a mechanical Q value (mechanical quality factor) lower than that of a material of the second portion 202. The mechanical Q value of the first portion 201 is set to be lower than that of the second portion 202.

The first portion 201 can be made of various materials having a low elastic modulus and a low mechanical Q value, for example, resin or rubber. For example, a film formed by resin such as polyethylene and polyimide can be preferably used as the first portion 201. The thickness of the first portion 201 can be set to 10 to 200 μm, for example. It is desirable that the first portion 201 be formed by porous resin for improving sound quality and be formed to have a thickness larger than that of the second portion 202. The difference in the thickness between the first portion 201 and the second portion 202 can be appropriately determined in accordance with desired sound pressure and sound quality.

The second portion 202 can be made of various materials having a high elastic modulus and a high mechanical Q value, for example, metal or ceramics. For example, the thickness of the second portion 202 can be set to 10 to 200 μm. Metal foil like aluminum foil can be preferably used as the second portion 202, for example.

The frame 10 is configured by an upper frame member 11 and a lower frame member 12 having the same shape (rectangular shape). A peripheral edge portion of the vibration body 20 is interposed between the upper frame member 11 and the lower frame member 12 to be fixed. The peripheral edge portion of the vibration body 20 is supported by the frame 10 in a state where a portion of the vibration body 20 at the inner side of the frame 10 can vibrate. Thus, the frame 10 plays a role in holding the vibration body 20 such that the vibration body 20 can vibrate, and fixes the vibration body 20 in a state where a predetermined tensile force is applied to the vibration body 20. That is to say, the vibration body 20 is provided (stretched) at the inner side of the frame 10 in a state where the tensile force is applied thereto. This configuration provides the acoustic generator 101 including the vibration body 20 with small variation such as deflection even if it is used for a long period of time.

The material of the frame 10 is not particularly limited and various known materials such as metal, plastic, glass, ceramic, and wood can be used. Among the various known materials, for example, stainless can be preferably used because it is excellent in mechanical strength and corrosion resistance. The thickness of the frame 10 is not also particularly limited and can be set appropriately depending on situations. For example, the thickness of the frame 10 can be set to appropriately 100 to 1000 μm.

The upper and lower main surfaces of the piezoelectric vibration element 30 have rectangular plate-like shapes. The piezoelectric vibration element 30 includes a laminate body 33, surface electrode layers 34 and 35, and first to third external electrodes. The laminate body 33 is formed by alternately laminating four piezoelectric layers 31 (31*a*, 31*b*, 31*c*, 31*d*) and three internal electrode layers 32 (32*a*, 32*b*, 32*c*). The surface electrode layers 34 and 35 are formed on the upper and lower surfaces of the laminate body 33, respectively. The first to third external electrodes are provided on end portions of the laminate body 33 in the lengthwise direction (Y-axis direction).

This first external electrode 36 is arranged on an end portion of the laminate body 33 in the −Y direction and is connected to the surface electrode layers 34 and 35 and the internal electrode layer 32*b*. This second external electrode 37 and this third external electrode (not illustrated) are arranged on an end portion of the laminate body 33 in the +Y direction with an interval therebetween in the X-axis direction. The second external electrode 37 is connected to the internal electrode layer 32*a* and the third external electrode (not illustrated) is connected to the internal electrode layer 32*c*.

Upper and lower end portions of the second external electrode 37 extend to the upper and lower surfaces of the laminate body 33 and folded external electrodes 37*a* are formed thereon. These folded external electrodes 37*a* are provided to extend so as to be spaced from the surface electrode layers 34 and 35 by predetermined distances such that they do not make contact with the surface electrode layers 34 and 35 formed on the surfaces of the laminate body 33. In the same manner, upper and lower end portions of the third external electrode (not illustrated) extend to the upper and lower surfaces of the laminate body 33 and folded external electrodes (not illustrated) are formed thereon. These folded external electrodes (not illustrated) are provided to extend so as to be spaced from the surface electrode layers 34 and 35 by predetermined distances such that they do not make contact with the surface electrode layers 34 and 35 formed on the surfaces of the laminate body 33.

The piezoelectric layers 31 (31*a*, 31*b*, 31*c*, 31*d*) are polarized in the directions as indicated by arrows in FIG. 1B. A voltage is applied to the first external electrode 36, the second external electrode 37, and the third external electrode such that the piezoelectric layers 31*c* and 31*d* expand when the piezoelectric layers 31*a* and 31*b* contract and the piezoelectric layers 31*c* and 31*d* contract when the piezoelectric layers 31*a* and 31*b* expand. Thus, the piezoelectric vibration element 30 is a bimorph-type piezoelectric element, and bends and vibrates in the Z-axis direction such that amplitude thereof changes in the Y-axis direction when an electric signal is input thereto.

Existing piezoelectric ceramics such as lead zirconate (PZ), lead zirconium titanate (PZT), Bi-layered compound, and a lead-free piezoelectric material like a tungsten bronze structure compound can be used as the piezoelectric layers 31. The thicknesses of the piezoelectric layers 31 can be set appropriately in accordance with desired vibration characteristics. For example, the thicknesses of the piezoelectric layers 31 can be set to 10 to 100 μm from a viewpoint of driving at a low voltage.

The internal electrode layers 32 can be made of various existing conductive materials. For example, the internal electrode layers 32 can contain a metal component made of silver and palladium and a material component forming the piezoelectric layers 31. The internal electrode layers 32 contain the ceramic component forming the piezoelectric layers 31, so that stress due to difference in the thermal expansion between the piezoelectric layers 31 and the internal electrode layers 32 can be reduced. The internal electrode layers 32 may not contain the metal component made of silver and palladium or may not contain the material component forming the piezoelectric layers 31.

The surface electrode layers 34 and 35 and the first to third external electrodes can be made of various existing conductive materials. For example, they can contain a metal component made of silver and a glass component. Thus, the surface electrode layers 34 and 35 and the first to third external electrodes contain the glass component, so that strong adhesion force can foe provided between the surface electrode layers 34 and 35 and the first to third external electrode and the piezoelectric layers 31 and the internal electrode layers 32. Note that they are not limited to contain the glass component.

Furthermore, the main surface of the piezoelectric vibration element 30 at the vibration body 20 side is bonded to the vibration body 20 with an adhesive 26. The thickness of the adhesive 26 is desirably equal to or smaller than 20 μm, more desirably equal to or smaller than 10 μm. When the thickness of the adhesive 26 is equal to or smaller than 20 μm, vibration of the laminate body 33 is easy to be transmitted to the vibration body 20.

The adhesive 26 can be formed, by curing well-known adhesives such as epoxy-based resin, silicone resin, and polyester-based resin. As a method of curing the adhesive, any method of thermal curing, photo-curing, and anaerobic curing may be used. It should be noted that an adhesive material other than the adhesive, such as double-stick tape, may be used as the adhesive 26.

Furthermore, in the acoustic generator 101 in the embodiment, a cover layer formed by the resin layer 40 covers at least a part of the surface of the vibration body 20. To be specific, in the acoustic generator 101 in the embodiment, a resin is filled at the inner side of the upper frame member 11 so as to embed therein the vibration body 20 and the piezoelectric vibration element 30, and the resin layer 40 is formed by the filled resin.

The resin layer 40 can be formed by epoxy-based resin, acryl-based resin, silicon-based resin, rubber, or the like. In consideration of reduction of the peaks and the dips, the resin layer 40 preferably covers the piezoelectric vibration element 30 completely but may not cover the piezoelectric vibration element 30 completely. Furthermore, the resin layer 40 may not necessarily cover the entire vibration body 20 and the resin layer 40 may be provided so as to cover a part of the vibration body 20 depending on cases. The thickness of the resin layer 40 can be appropriately set, for example, is set to approximately 0.1 mm to 1 mm. The resin layer 40 may not be provided depending on cases.

Thus, resonance of the vibration body 20 can be moderately damped by providing the resin layer 40 as described above. This can reduce the peaks and the dips in the frequency characteristics of the sound pressure that are generated due to the resonance phenomenon to be small, thereby reducing frequency-related variation of the sound pressure.

As described above, in the acoustic generator 101 in the embodiment, the vibration body 20 has a configuration in which the thin plate-like first portion 201 and the thin plate-like second portion 202 having different elastic moduli are laminated. This configuration can generate high-quality sound with small frequency-related variation of the sound pressure for the following reason. The sound pressure is high in a low frequency region with vibration of only the first portion 201 having a low elastic modulus and the sound pressure is high in a high frequency region with vibration of only the second portion 202 having a high elastic modulus. That is, it is considered that variation of the sound pressure in a wide frequency band can be reduced macroscopically by causing the vibration body 20 to have the configuration in which the first portion 201 and the second portion 202 are laminated.

In the acoustic generator 101 in the embodiment, the piezoelectric vibration element 30 is provided on the main surface of the vibration body 20 at the side of the first portion 201 having a relatively low elastic modulus and is attached to the first portion 201. This configuration can prevent the sound pressure in a high-frequency region from being too high.

Furthermore, in the acoustic generator 101 in the embodiment, the piezoelectric vibration element 30 is provided on the main surface of the vibration body 20 at the side of the first portion 201 having a relatively low mechanical Q value and is attached to the first portion 201. This configuration enhances an effect that the resonance is damped and can reduce the peaks and the dips in the frequency characteristics of the sound pressure that are generated due to the resonance phenomenon to be small, thereby reducing variation of the sound pressure in a narrow frequency range microscopically.

In the acoustic generator 101 in the embodiment, the thickness of the first portion 201 is set to be larger than that of the second portion 202. This configuration can enhance an effect of the reduction in the variation of the sound pressure by the first portion 201. In addition, the thickness of the first portion 201 having a relatively low elastic modulus is set to be larger than that of the second portion 202, thereby improving sound quality while keeping the mechanical strength.

In the acoustic generator 101 in the embodiment, the first portion 201 is made of resin and the second portion 202 is made of metal. This provides the acoustic generator 101 that is capable of generating high-quality sound, has high mechanical strength, and can be manufactured easily. Moreover, the first portion 201 is made of porous resin. This further enhances the effect that the resonance is damped and can further reduce the peaks and the dips in the frequency characteristics of the sound pressure that are generated due to the resonance phenomenon to be small, thereby reducing variation of the sound pressure in a narrow frequency range microscopically.

In the acoustic generator 101 in the embodiment, the entirety of the vibration body 20 has the configuration in which the first portion 201 and the second portion 202 are laminated. With this configuration, the entirety of the vibration body 20 can vibrate uniformly so as to generate higher-quality sound.

In the acoustic generator 101 in the embodiment, the resin is filled at the inner side of the upper frame member 11 so as to embed therein the vibration body 20 and the piezoelectric vibration element 30, and the cover layer (resin layer 40) is formed by the filled resin. That is to say, in the acoustic generator 101 in the embodiment, the cover layer further covers at least a part of the surface of the vibration body 20 at the side at which the piezoelectric vibration element 30 is arranged. This configuration further enhances the effect that the resonance is damped and can further reduce the peaks and the dips in the frequency characteristics of the sound pressure that are generated due to the resonance phenomenon to be small, thereby reducing variation of the sound pressure in a narrow frequency range microscopically.

Figure 2A:
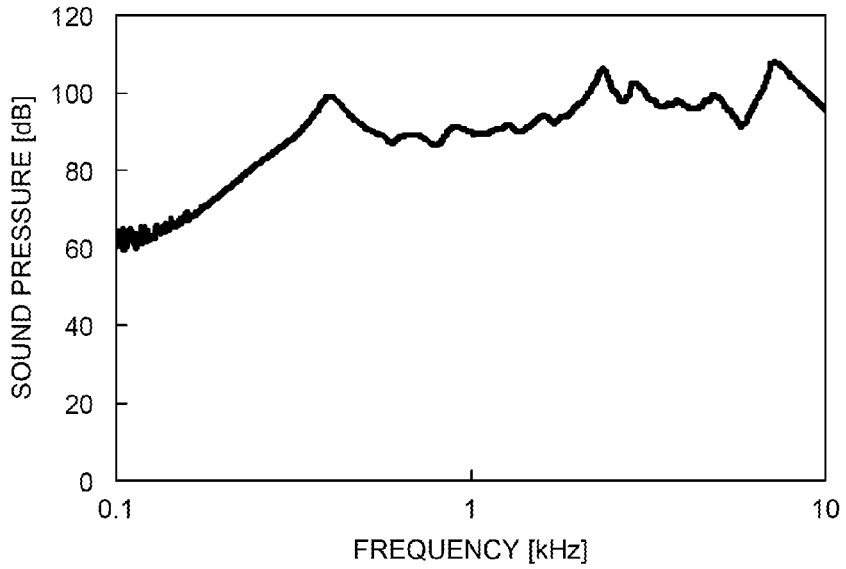
FIG. 2A is a graph illustrating an example of frequency dependence of sound pressure in the acoustic generator in the first embodiment.
Figure 2B:
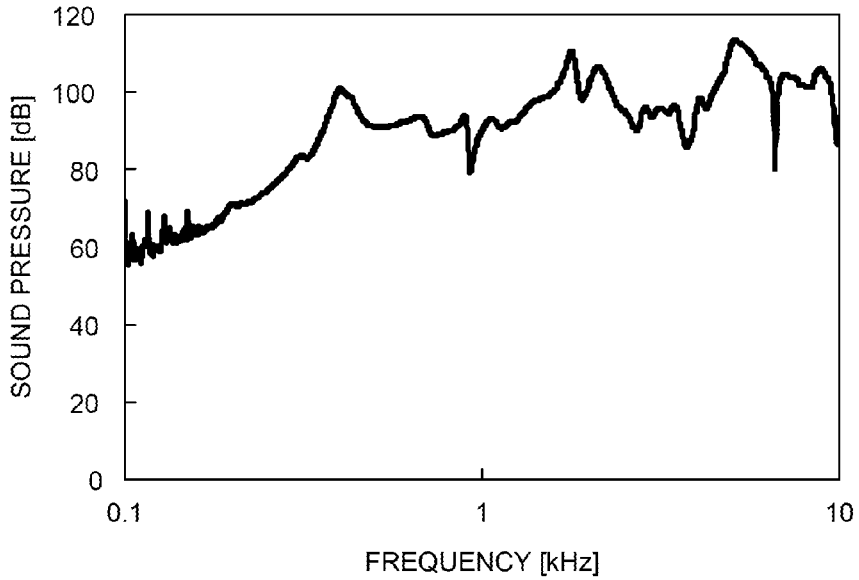
FIG. 2B is a graph illustrating an example of frequency dependence of sound pressure in an acoustic generator according to a comparison example.

FIG. 2A is a graph illustrating an example of frequency dependence of sound pressure in the acoustic generator 101 in the embodiment. FIG. 2B is a graph illustrating an example of frequency dependence of sound pressure in an acoustic generator in a comparison example. The acoustic generator in the comparison example has a configuration that is the same as that of the acoustic generator 101 in the embodiment other than a point that the vibration body 20 is formed by only one resin film. In the graphs as illustrated in FIG. 2A and FIG. 2B, the transverse axis indicates the frequency and the longitudinal axis indicates the sound pressure.

As will be obvious from comparison between FIG. 2A and FIG. 2B, the acoustic generator 101 in the embodiment can generate high-quality sound with small frequency-related variation of the sound pressure in comparison with the acoustic generator in the comparison example.

The magnitude relation between the elastic modulus of the first portion 201 and the elastic modulus of the second portion 202 is obtained as follows. For example, it is sufficient that the indentation hardness test is executed on each of the surfaces of the first portion 201 and the second portion 202 to measure elastic moduli of the respective surfaces and the magnitude relation thereof is compared. The indentation hardness test is a test in which an indenter is pressed into a surface of a material the elastic modulus of which is to be measured by gradually applying load, and then, the load is gradually cancelled so as to calculate hardness and the elastic modulus based on a relation between change in the load and change in a displacement amount of the indenter. For example, the indentation hardness test can be executed using various test machines (referred to as a hardness test machine, an indentation hardness test machine, or the like) like a hardness test machine DUH-211S manufactured by Shimadzu Corporation.

Next, an example of a method of manufacturing the acoustic generator 101 in the embodiment will be described. The piezoelectric vibration element 30 is prepared initially. First of all, a binder, a dispersant, a plasticizer, and a solvent are kneaded into powder of a piezoelectric material so as to produce slurry. As the piezoelectric material, any of lead-based and lead-free materials can be used.

Subsequently, a green sheet is produced by shaping the slurry into a sheet form. Then, conductive pastes are printed on the green sheet so as to form a conductive pattern serving as the internal electrode. Three green sheets on which the electrode patterns are formed are laminated on one another and a green sheet on which the electrode pattern is not printed is laminated thereon so as to produce a laminate molded body. Then, the laminate molded body is degreased, sintered, and cut to have a predetermined dimension so as to provide the laminate body 33.

Thereafter, the outer peripheral portion of the laminate body 33 is processed if necessary. Conductive pastes for forming the surface electrode layers 34 and 35 are printed on both the main surfaces of the laminate body 33 in the laminate direction. Subsequently, conductive pastes for forming the first to third external electrodes are printed on both the end surfaces of the laminate body 33 in the lengthwise direction (Y-axis direction). Then, the electrodes are baked at a predetermined temperature. In this manner, the piezoelectric vibration element 30 as illustrated in FIG. 1A and FIG. 1B can be provided.

Thereafter, in order to give piezoelectric property to the piezoelectric vibration element 30, a direct-current voltage is applied thereto through the first to third external electrodes so as to polarize the piezoelectric layers 31 of the piezoelectric vibration element 30. The DC voltage is applied such that the polarization is performed in the directions as indicated by the arrows in FIG. 1B.

Then, the vibration body 20 is prepared and the outer peripheral portion of the vibration body 20 is interposed between the frame members 11 and 12 so as to be fixed in a state where a tensile force is applied to the vibration body 20. Thereafter, the adhesive forming the adhesive 26 is applied onto the vibration body 20. The piezoelectric vibration element 30 at the surface electrode 34 side is pressed against the vibration body 20. Then, the adhesive is cured by irradiating it with heat or ultraviolet rays. The resin before cured is made to flow to the inner side of the frame member 11, and is cured so as to form the resin layer 40. In this manner, the acoustic generator 101 in the embodiment can be manufactured.

Second Embodiment

Figure 3:
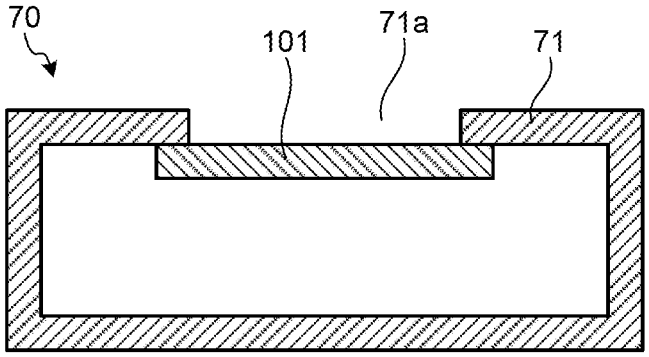
FIG. 3 is a view for explaining the configuration of an acoustic generation device according to a second embodiment.

Next, the configuration of an acoustic generation device 70 according to a second embodiment will be described. FIG. 3 is a view illustrating an example of the configuration of the acoustic generation device 70 including the acoustic generator 101 according to the above-mentioned first embodiment. In FIG. 3, only constituent components necessary for explanation are illustrated and the detail configuration and common constituent components of the acoustic generator 101 are not illustrated.

The acoustic generation device 70 in the embodiment is an acoustic generation device such as a what-is-called speaker. As illustrated in FIG. 3, for example, the acoustic generation device 70 includes a housing 71 and the acoustic generator 101 attached to the housing 71. The housing 71 has a box-like shape of rectangular parallelepiped and has an opening 71*a* on one surface. For example, the housing 71 can be made of a known material such as plastic, metal, and wood. The housing 71 is not limited to have the box-like shape of rectangular parallelepiped and may have various shapes such as a circular cylindrical shape and a frustum shape.

The acoustic generator 101 is attached to the opening 71*a* of the housing 71. The acoustic generator 101 corresponds to the acoustic generator in the above-mentioned first embodiment and description of the acoustic generator 101 is omitted. The acoustic generation device 70 having the configuration generates sound using the acoustic generator 101 generating high-quality sound, thereby generating high-quality sound. The acoustic generation device 70 can resonate the sound generated from the acoustic generator 101 in the housing 71 so as to increase the sound pressure in a low-frequency band, for example. A place at which the acoustic generator 101 is attached can be set freely. The acoustic generator 101 may be attached to the housing 71 through another member.

Third Embodiment

Figure 4:
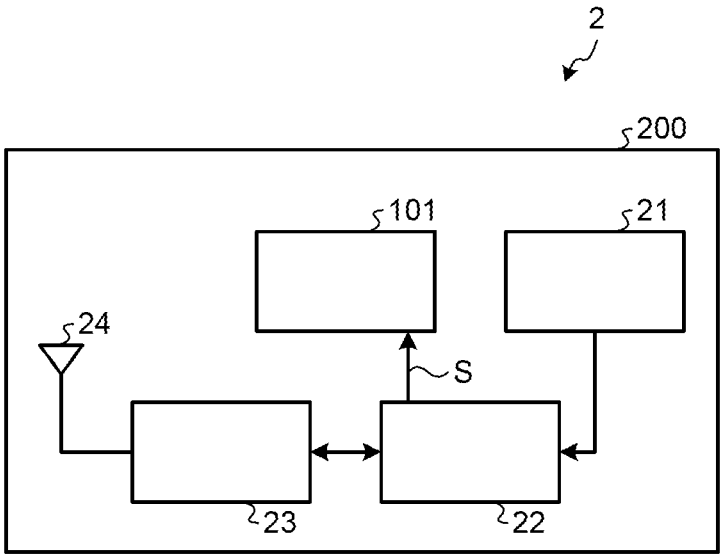
FIG. 4 is a diagram for explaining the configuration of an electronic device according to a third embodiment.

Next, the configuration of an electronic device according to a third embodiment will be described. FIG. 4 is a view illustrating an example of the configuration of an electronic device 2 including the acoustic generator 101 in the above-mentioned first embodiment. In FIG. 4, only constituent components necessary for explanation are illustrated and the detail configuration and common constituent components of the acoustic generator 101 are not illustrated. The electronic device 2 includes a case 200, the acoustic generator 101 provided in the case 200, and an electronic circuit connected to the acoustic generator 101.

To be specific, as illustrated in FIG. 4, the electronic device 2 includes an electronic circuit including a control circuit 21, a signal processing circuit 22, and a communication circuit 23; an antenna 24; and the case 200 accommodating these. Other electric members (for example, devices such as a display and a microphone and circuits) included in the electronic device 2 are not illustrated.

The communication circuit 23 receives a signal input from the antenna 24 and outputs it to the signal processing circuit 22. The signal processing circuit 22 processes the signal input from the communication circuit 23 to generate a sound signal S, and outputs it to the acoustic generator 101. The acoustic generator 101 generates sound based on the sound signal S. The control circuit 21 controls the entirety of the electronic device 2 including the signal processing circuit 22 and the communication circuit 23.

The electronic device 2 having the configuration includes the acoustic generator 101 capable of generating high-quality sound with small frequency-related variation of the sound pressure, thereby generating high-quality sound.

Although FIG. 4 illustrates an example in which the acoustic generator 101 is attached directly to the case 200 of the electronic device 2, the acoustic generator 101 is not limited to be attached in this manner. For example, the acoustic generation device 70 in which the acoustic generator 101 is attached to the housing 71 as illustrated in FIG. 3 may be attached to the case 200 of the electronic device 2.

The electronic device 2 on which the acoustic generator 101 is mounted is not limited to conventionally well-known electronic devices that generate sound, such as mobile phones, tablet terminals, televisions, and audio devices. The electronic device 2 on which the acoustic generator 101 is mounted may be electric products such as refrigerators, microwaves, vacuum cleaners, and washing machines.

Fourth Embodiment

Figure 5A:
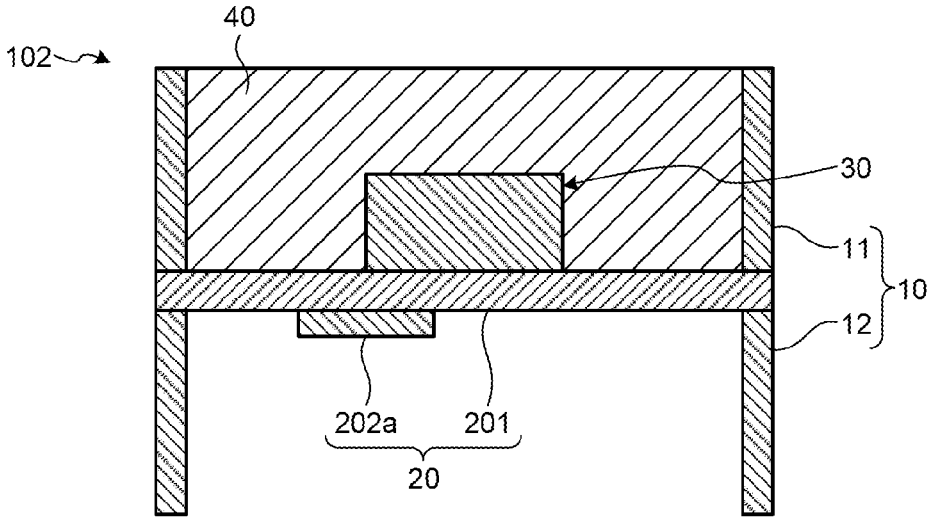
FIG. 5A is a cross-sectional view schematically illustrating an acoustic generator according to a fourth embodiment.

Next, the configuration of an acoustic generator 102 according to a fourth embodiment will be described with reference to FIG. 5A. FIG. 5A is a cross-sectional view schematically illustrating the configuration of the acoustic generator 102 in the embodiment. In FIG. 5A, illustration of the configuration of the piezoelectric vibration element 30 and the adhesive 26 is omitted. In the embodiment, only points different from the acoustic generator 101 in the above-mentioned first embodiment are described, and the same reference numerals denote the same constituent components and overlapped description thereof is omitted.

As illustrated in FIG. 5A, in the acoustic generator 102 in the embodiment, the vibration body 20 is configured by the first portion 201 and a second portion 202*a*. The second portion 202*a* is locally provided on a part of the lower main surface (at the side opposite to the piezoelectric vibration element 30) of the first portion 201. That is to say, in the acoustic generator 102 in the embodiment, one of the first portion 201 and the second portion 202*a* is locally provided on the other of the first portion 201 and the second portion 202*a*. This configuration can reduce frequency-related variation of sound pressure and can finely adjust a vibration state of the vibration body 20.

The second portion 202*a* is provided on a portion of a composite vibration body configured by the first portion 201 and the piezoelectric vibration element 30 on which stiffness is changed when seen from the above. The portion of the composite vibration body configured by the first portion 201 and the piezoelectric vibration element 30 on which the stiffness changes is a boundary between a portion on which the piezoelectric vibration element 30 is present and a portion on which the piezoelectric vibration element 30 is absent. The second portion 202*a* is provided across the boundary, that is, across both the portion on which the piezoelectric vibration element 30 is present and the portion on which the piezoelectric vibration element 30 is absent. Stress is concentrated on the portion on which the stiffness changes. This configuration can improve the sound quality of sound that is generated. In the specification, when the acoustic generator is seen from the above, it is seen from the above along the thickness direction (direction perpendicular to the main surface of the vibration body 20, Z-axis direction in FIG. 5A) of the vibration body 20 unless otherwise described.

Fifth Embodiment

Figure 5B:
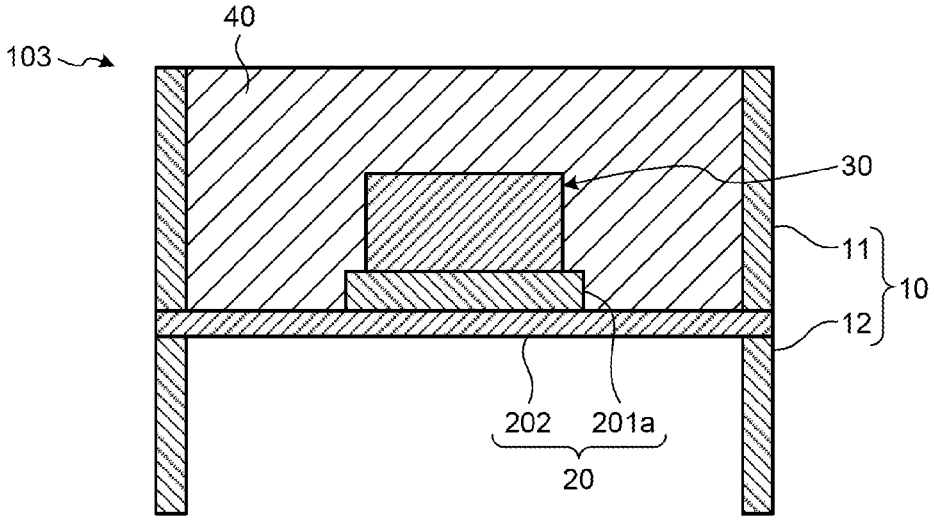
FIG. 5B is a cross-sectional view schematically illustrating an acoustic generator according to a fifth embodiment.

Next, the configuration of an acoustic generator 103 according to a fifth embodiment will be described with reference to FIG. 5B. FIG. 5B is a cross-sectional view schematically illustrating the configuration of the acoustic generator 103 in the embodiment. In FIG. 5B, illustration of the configuration of the piezoelectric vibration element 30 and the adhesive 26 is omitted. In the embodiment, only points different from the acoustic generator 101 in the above-mentioned first embodiment are described, and the same reference numerals denote the same constituent components and overlapped description thereof is omitted.

As illustrated in FIG. 5B, in the acoustic generator 103 in the embodiment, the vibration body 20 is configured by a first portion 201*a* and the second portion 202. The first portion 201*a* is provided on a part of the upper main surface (at the side of the piezoelectric vibration element 30) of the second portion 202 and the piezoelectric vibration element 30 is attached onto the first portion 201*a*. As in the acoustic generator 101 in the first embodiment and the acoustic generator 102 in the fourth embodiment, the acoustic generator 103 in the embodiment having this configuration can also generate high-quality sound with small frequency-related variation of sound pressure.

Sixth Embodiment

Figure 6:
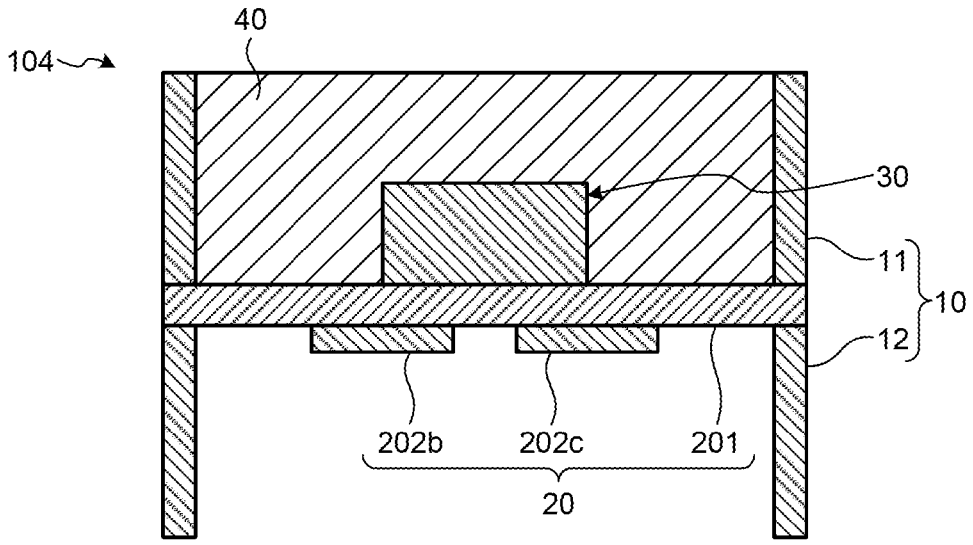
FIG. 6 is a cross-sectional view schematically illustrating an acoustic generator according to a sixth embodiment.

Next, the configuration of an acoustic generator 104 according to a sixth embodiment will be described with reference to FIG. 6. FIG. 6 is a cross-sectional view schematically illustrating the configuration of the acoustic generator 104 in the sixth embodiment. In FIG. 6, illustration of the configuration of the piezoelectric vibration element 30 and the adhesive 26 is omitted. In the embodiment, only points different from the acoustic generator 102 in the above-mentioned fourth embodiment are described, and the same reference numerals denote the same constituent components and overlapped description thereof is omitted.

In the acoustic generator 104 in the sixth embodiment, as illustrated in FIG. 6, the vibration body 20 is configured by the first portion 201 and two second portions (202*b*, 202*c*) and the two second portions 202*b* and 202*c* are provided on the lower main surface (at the side opposite to the piezoelectric vibration element 30) of the first portion 201 with a predetermined space therebetween in the direction parallel with the main surface. The two second portions 202*b* and 202*c* have different elastic moduli. For example, when any one of the two second portions 202*b* and 202*c* is formed by aluminum foil, the other thereof is formed by another metal foil having different elastic modulus desirably. The acoustic generator 104 in the embodiment having this configuration can generate high-quality sound with small frequency-related variation of sound pressure.

Although the two second portions 202*b* and 202*c* are provided on the other main surface of the first portion 201 in FIG. 6, equal to or more than three second portions can be

Seventh Embodiment

Figure 7:
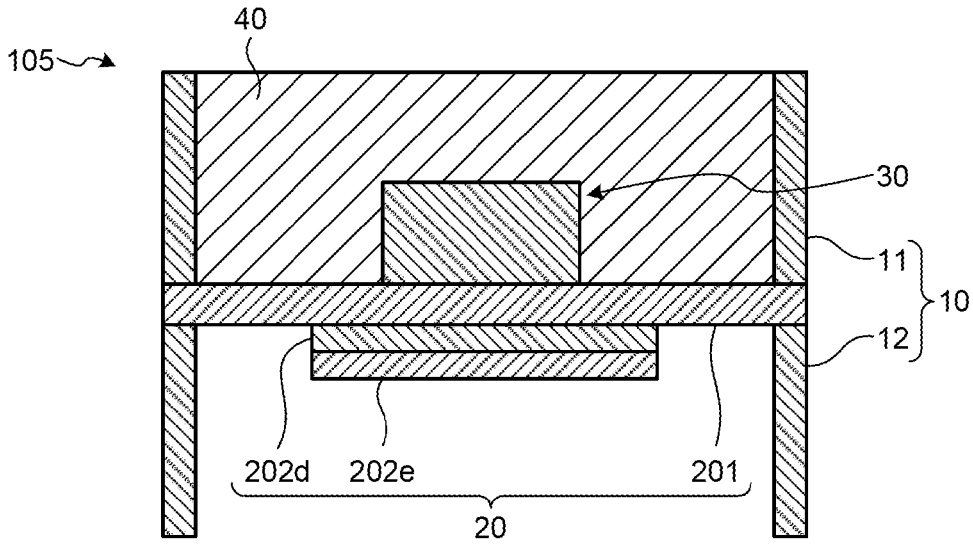
FIG. 7 is a cross-sectional view schematically illustrating an acoustic generator according to a seventh embodiment.

Next, the configuration of an acoustic generator 105 according to a seventh embodiment will be described with reference to FIG. 7. FIG. 7 is a cross-sectional view schematically illustrating the acoustic generator 105 in the seventh embodiment. In FIG. 7, illustration of the configuration of the piezoelectric vibration element 30 and the adhesive 26 is omitted. In the embodiment, only points different from the acoustic generator 102 in the above-mentioned fourth embodiment are described, and the same reference numerals denote the same constituent components and overlapped description thereof is omitted.

In the acoustic generator 105 in the embodiment, as illustrated in FIG. 7, the vibration body 20 is configured by the first portion 201 and two second portions 202*d* and 202*e*. The first portion 201 and the two second portions 202*d* and 202*e* are sequentially laminated and the elastic moduli of the respective layers are set to be higher gradually as they are farther from the first portion 201. To be specific, in the acoustic generator 105 in the embodiment, the two second portions 202*d* and 202*e* laminated on each other are provided on the lower main surface of the first portion 201. The elastic modulus of the second portion 202*e* as a second layer is set to be higher than that of the second portion 202*d* as a first layer that is provided directly on the first portion 201.

In this case, for example, when the second portion 202*d* as the first layer is formed by aluminum foil, the second portion 202*e* as the second layer is formed by another metal foil having an elastic modulus higher than that of the aluminum foil. In contrast, when the second portion 202*e* as the second layer is formed by aluminum foil, the second portion 202*d* as the first layer is formed by another metal foil having an elastic modulus lower than that of the aluminum foil.

The acoustic generator 105 in the embodiment having this configuration can generate higher-quality sound with smaller frequency-related variation of sound pressure. Although the two second portions 202*d* and 202*e* are provided on the other side surface of the first portion 201 in the example as illustrated in FIG. 7, equal to or more than three second portions may be laminated. Although it is desirable that types of the metal foils of the respective layers be varied and the elastic moduli thereof be set to be higher gradually as they are farther from the first portion 201, they are not necessarily limited to this configuration. Furthermore, the thicknesses of the metal foils of the respective layers can be also varied appropriately.

Modifications

The invention is not limited to the above-mentioned embodiments and various changes or improvements can be made in a range without departing from a concept of the invention.

For example, although the piezoelectric vibration element 30 is provided on the main surface of the vibration body at the side of the first portion 201 having the relatively low elastic modulus in the above-mentioned embodiments, the piezoelectric vibration element 30 may be provided on the surface thereof at the side of the second portion 202 having the relatively high elastic modulus depending on cases.

Although the examples in which the thickness of the first portion 201 is set to be larger than the thickness of the second portion 202 are indicated in the above-mentioned embodiments, the thickness of the first portion 201 may be smaller than the thickness of the second portion 202.

Although the examples in which one piezoelectric vibration element 30 is arranged on the vibration body 20 are indicated in the above-mentioned embodiments, a plurality of piezoelectric vibration elements 30 may be arranged on the vibration body 20. Although the piezoelectric vibration element 30 has the rectangular shape when seen from the above in the above-mentioned embodiments, for example, the piezoelectric vibration element 30 may have another shape such as an elliptical shape.

Although the examples in which the bimorph-type piezoelectric vibration element 30 is employed are indicated in the above-mentioned embodiments, the piezoelectric vibration element 30 is not limited thereto. For example, the same effects can be provided even by using a unimorph-type piezoelectric vibration element configured by bonding a plate made of metal or the like to one main surface of the piezoelectric vibration element that vibrates to expand and contract in the plane direction, instead of the bimorph-type piezoelectric vibration element. Alternatively, the piezoelectric vibration elements that vibrate to expand and contract in the plane direction may be provided on both the surfaces of the vibration body 20, that is, the unimorph-type or bimorph-type piezoelectric vibration elements may be provided on both the surfaces of the vibration body 20.

Those skilled in the art can derive additional effects and modifications easily. A wider aspect of the invention is not limited by specific details and representative embodiments that are represented and described as described above. Accordingly, various changes can be made without departing from the spirit or the scope of the general concept of the invention defined by the accompanying scope of the invention and equivalents thereof.

The invention claimed is:

1. An acoustic generator comprising:
a frame;
a vibration body provided at an inner side of the frame;
a piezoelectric vibration element provided on the vibration body; and
a resin layer provided on the vibration body so as to cover the piezoelectric vibration element, wherein
the vibration body has a configuration in which a thin plate-like first portion and a thin plate-like second portion having different elastic moduli are laminated.

2. The acoustic generator according to claim 1, wherein
the first portion has a lower elastic modulus than the second portion,
the piezoelectric vibration element is provided on an outer surface of the vibration body, and
the piezoelectric vibration element is provided on the first portion.

3. The acoustic generator according to claim 1, wherein
the first portion has a larger thickness than that of the second portion.

4. The acoustic generator according to claim 1, wherein the first portion is made of resin and the second portion is made of metal.

5. The acoustic generator according to claim 1, wherein the first portion is made of porous resin.

6. The acoustic generator according to claim 1, wherein entirety of the vibration body has a configuration in which the first portion and the second portion are laminated.

7. The acoustic generator according to claim 1, wherein one of the first portion and the second portion of the vibration body is locally provided on the other of the first portion and the second portion.

8. The acoustic generator according to claim 7, wherein
a composite vibration body is comprised of the piezoelectric vibration element and the other of the first portion and the second portion, and
the one of the first portion and the second portion is provided on a portion of the composite vibration body on which stiffness changes when seen from the above.

9. The acoustic generator according to claim 1, wherein at least a part of a surface of the vibration body at a side at which the piezoelectric vibration element is arranged is further covered by a cover layer.

10. The acoustic generator according to claim 1, wherein the vibration body and the piezoelectric vibration element are bonded to each other with an adhesive.

11. An acoustic generation device comprising at least:
a housing; and
the acoustic generator according to claim 1 that is provided on the housing.

12. An electronic device comprising at least:
a case;
the acoustic generator according to claim 1 that is provided on the case; and
an electronic circuit connected to the acoustic generator, wherein
the electronic device has a function of generating sound from the acoustic generator.

13. An acoustic generator comprising:
a frame;
a vibration body provided inside of the frame;

a piezoelectric vibration element provided on the vibration body; and a resin layer provided on the vibration body so as to cover the piezoelectric vibration element, wherein the vibration body has a configuration in which a first portion and a second portion are laminated, and the first portion and the second portion each have different elastic moduli.

14. The acoustic generator according to claim 13, wherein each of the first portion and the second portion has a shape like a thin plate.

15. The acoustic generator according to claim 1, wherein the first portion has a lower elastic modulus than the second portion, the piezoelectric vibration element is provided on an outer surface of the vibration body, and the piezoelectric vibration element is provided on the first portion.

16. The acoustic generator according to claim 13, wherein the first portion has a larger thickness than the second portion.

17. The acoustic generator according to claim 13, wherein entirety of the vibration body has a configuration in which the first portion and the second portion are laminated.

18. The acoustic generator according to claim 13, wherein one of the first portion and the second portion of the vibration body is locally provided on the other of the first portion and the second portion, a composite vibration body is comprised of the piezoelectric vibration element and the other of the first portion and the second portion, and the one of the first portion and the second portion is provided on a portion of the composite vibration body on which stiffness changes when viewed in a plan view.

19. An acoustic generation device comprising:

a housing; and the acoustic generator according to claim 13 that is provided on the housing.

20. An electronic device comprising:

a case;

the acoustic generator according to claim 13 that is provided on the case; and an electronic circuit connected to the acoustic generator.

* * * * *